United States Patent [19]

Stahlecker et al.

[11] Patent Number: 4,638,626

[45] Date of Patent: Jan. 27, 1987

[54] FIBER FEED CHANNEL ARRANGEMENT FOR OPEN END FRICTION SPINNING MACHINE

[75] Inventors: Fritz Stahlecker, Josef-Neidhart-Strasse 18, 7347 Bad Uberkingen; Hans Stahlecker, Haldenstrasse 20, 7334 Süssen, both of Fed. Rep. of Germany

[73] Assignees: Fritz Stahlecker; Hans Stahlecker, both of Fed. Rep. of Germany

[21] Appl. No.: 802,457

[22] Filed: Nov. 27, 1985

[30] Foreign Application Priority Data

Dec. 1, 1984 [DE] Fed. Rep. of Germany ..... 3443901

[51] Int. Cl.[4] ..... D01H 1/135; D01H 7/898

[52] U.S. Cl. ..... 57/401; 57/413

[58] Field of Search ..... 57/400, 401, 404, 408, 57/413

[56] References Cited

U.S. PATENT DOCUMENTS 4,014,162 3/1977 Stahlecker ..... 57/413

4,222,222 9/1980 Didek et al. ..... 57/401

4,291,528 9/1981 Miyamoto et al. ..... 57/413

4,541,233 9/1985 Raasch et al. ..... 57/401 X

FOREIGN PATENT DOCUMENTS 0052412 5/1982 European Pat. Off. .

3306225 8/1984 Fed. Rep. of Germany .

*Primary Examiner*—Donald Watkins

*Attorney, Agent, or Firm*—Barnes & Thornburg

[57] ABSTRACT

An arrangement for open-end friction spinning having rollers that are rotatably arranged next to one another in fixed relation is provided wherein the fiber feeding duct assigned to the wedge-shaped gap is also mounted stationarily. As a result, inaccuracies are avoided in adjustment of the mouth of the fiber feeding duct with respect to the wedge-shaped gap. For cleaning of the fiber feeding duct and the wedge-shaped gap, it is provided that the fiber feeding duct is connected to a compressed-air supplying pipe so that a jet of compressed air is blown through the fiber feeding duct into the wedge-shaped gap.

25 Claims, 7 Drawing Figures

59
57
15
20
14
19
13
9
41
42
44
5
58
45
11
43
6
23
3
49
24
1
2
4
8
7
17
39
48
16
47
25
12
10
35
36
33
22
21
38
37

FIBER FEED CHANNEL ARRANGEMENT FOR OPEN END FRICTION SPINNING MACHINE

BACKGROUND AND SUMMARY OF THE INVENTION

This invention relates generally to an arrangement for open-end friction spinning having two rollers that are arranged next to one another and are drivable in the same rotational direction. The rollers are disposed in a joint structural unit and form a wedge-shaped gap used for the formation of yarn. A mouth of a fiber feeding duct is located opposite the wedge-shaped gap.

In a known arrangement of the initially mentioned type as disclosed in German Application DE-OS No. 33 06 225, the fiber feeding duct leading from an opening roller to the wedge-shaped gap is divided. The part of the fiber feeding duct that is located in the area of the rollers which terminates with a mouth that is opposite the wedge-shaped gap is housed in a pivotable housing part. This housing part can be swivelled away from the rollers for exposing the wedge-shaped gap. As a result, the wedge-shaped gap as well as the interior of the fiber feeding duct become easily accessible for servicing. In practice, it was found that the position of the fiber feeding duct relative to the wedge-shaped gap and in particular the position of the mouth of the fiber feeding duct have an effect on the spinning result. It is therefore necessary that a very precise positioning be made possible in which case the tolerances should not exceed the magnitude of 100 microns. This means that for the pivotal bearing as well as for the locking of the operating position correspondingly narrow tolerances must be maintained which, in the case of a series production, can be realized only with relatively high manufacturing expenditures.

In the case of another construction disclosed in German EP-OS No. 52 412, two exposed rollers are provided. In order to be able to clean the wedge-shaped gap, into which a stationarily arranged fiber feeding duct leads, one of the two rollers can be swivelled away from the fiber feeding duct and the other roller. The cleaning possibilities are limited because the parts are not completely accessible. However, in addition, because of the required precisions, especially for maintaining the distance between the two rollers with respect to one another, very high manufacturing expenditures are necessary.

One object of the present invention is the provision of an arrangement of the initially mentioned type in such a way that the selected positioning distances between the rollers and the mouth of the fiber feeding duct is safely maintained even over an extended operating time.

Another object of the present invention is the provision of such an arrangement without the requirement of high expenditures in view of series production.

These and other objects are attained by providing an arrangement wherein there is a connection between at least one part of the fiber feeding duct containing the mouth and the structural part receiving the shafts of the rollers by means of a rigid connecting device.

By means of this type of stationary arrangement of the fiber feeding duct with respect to the rollers, it is possible to precisely adjust the required distances in the manufacturing plant without the requirement of changes during the operating time. The means that are required for these adjustments may then be used for a plurality of devices so that the costs required for this purpose are not expensive.

In one development of the invention, it is provided that the part of the fiber feeding duct containing the mouth is contained in a structural part which, by means of one or several webs, is mounted at a roller housing receiving the shafts of the rollers and that a structural part containing the other part of the fiber duct is movable with respect to the other structural part. As a result, it is achieved that the overall accessibility of the individual elements is not too restricted.

In the case of another developement, it is provided that the fiber feeding duct is constructed in one part with an opening roller housing which is mounted at a roller housing receiving the shafts of the rollers. This would also result in a simple structural unit.

In another embodiment of the invention, it is provided that an opening roller housing which contains a part of the fiber feeding duct is rigidly fastened at a roller housing receiving the shafts of the roller and that, at the opening roller housing, a structural part is rigidly fastened that has the part of the fiber feeding duct containing the mouth. In the case of this embodiment also, prefabricated structural units may be created that can be adjusted in the manufacturing plant.

In a further development of the invention, it is provided that the structural part containing the mouth or the opening roller housing with the fiber feeding duct, by means of fastening means causing an precise positioning, is fastened at the structural part receiving the shafts of the rollers. As a result, it is possible to in a simple way also subsequently exchange the parts that must be adjusted precisely to one another. If necessary, it is possible to exchange them for better suitable structural parts in the case of a changing-over to a different fiber material, without the requirement of special adjusting work.

In a further developement of the invention, it is provided that the part of the fiber feeding duct containing the mouth is worked into a narrow web-type structural component extending in the longitudinal direction of the wedge-shaped gap. As a result, the area of the rollers that must be made accessible for servicing is not significantly restricted. In order to nevertheless protect the rollers and also possibly prevent the entering of secondary air, in a further development of the invention, a covering for the rollers is provided which is arranged so that it can be moved away from the rollers, which together with the roller housing forms a chamber largely surrounding the rollers and which is equipped with a recess for the structural component containing the fiber feeding duct.

In a further development of the invention, it is provided that the fiber feeding duct can be connected to a compressed-air source in such a way that via the mouth of the fiber feeding duct a jet of compressed air can be blown into the wedge-shaped gap. As a result, it is ensured that also the area of the wedge-shaped gap is accessible, especially for cleaning. Also, after a yarn breakage, the wedge-shaped gap can be securely freed from fiber residues or similar material remaining in this area although the mouth of the fiber feeding duct is stationary in relation to the rollers. The removal of such fiber residues or similar materials can be carried out without difficulty by means of a jet of compressed air.

In a further developement of the invention, it is provided that the fiber feeding duct is contained in at least two structural parts that are arranged behind one another, of which the structural part that faces away from the mouth can be moved away in order to apply a compressed air supplying means to the other structural part. This ensures in a simple way that a sufficiently strong jet of compressed air can be aimed at the wedge-shaped gap.

In a further development of the invention, it is provided that the compressed air supplying means is a component of a movable servicing apparatus that can be applied to the arrangement. In an advantageous development, it is provided in this case that the servicing apparatus is equipped with means for moving away the structural component facing away from the mouth of the fiber feeding duct. These means, in a very simple way, may be realized by the fact that the servicing apparatus is equipped with a head piece that can be inserted between the two structural components. The head piece is advantageously equipped with two blow openings aimed into the two parts of the fiber feeding duct. The head piece may therefore, on the one hand, move the two structural components apart and is simultaneously used as the compressed air supplying means so that the expenditures for the driving element can be kept relatively low.

In a further development of the invention, it is provided that a suction pipe is aimed into the wedge-shaped gap which can be connected to a vacuum source. Via this suction pipe, it is possible to also remove the dirt that is detached in the wedge-shaped gap by the jet of compressed air. The cleaning process can thus be controlled better.

Other objects, advantages and novel features of the present invention will become apparent from the following detailed description of the invention when considered in conjunction with the accompanying drawings.

DETAILED DESCRIPTION OF THE DRAWINGS

Figure 1:
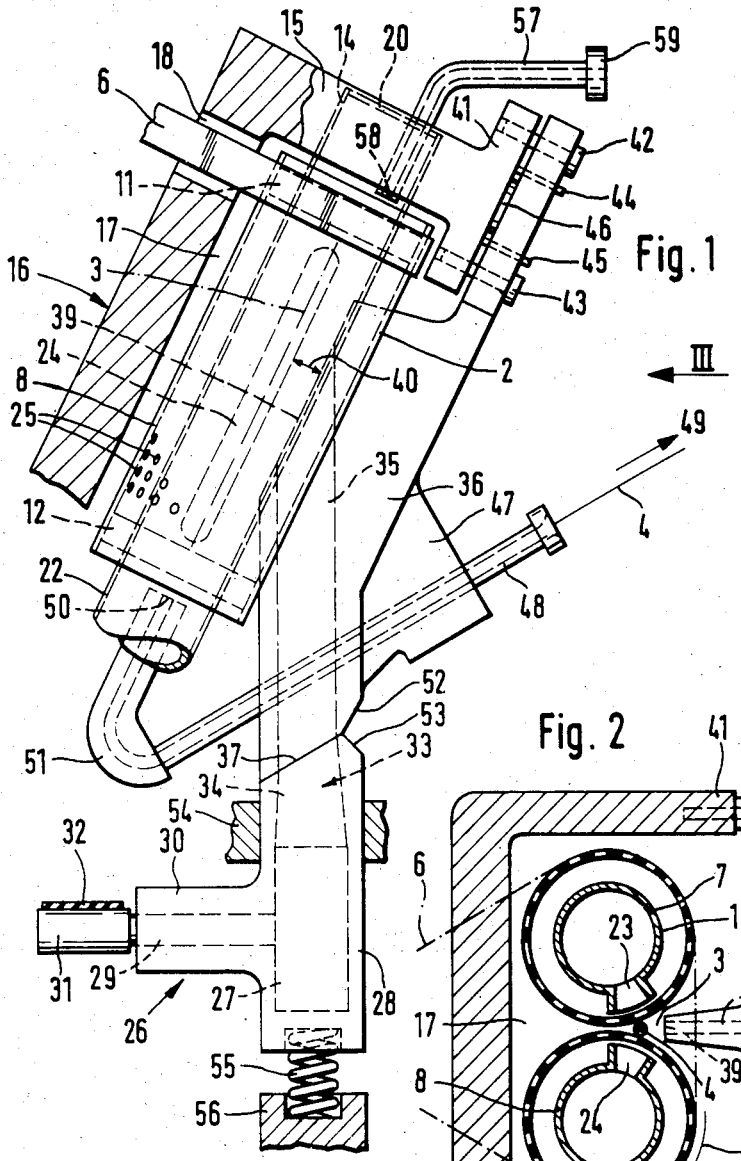
FIG. 1 is a partially cut lateral view of an arrangement for open-end friction spinning according to the present invention.
Figure 2:
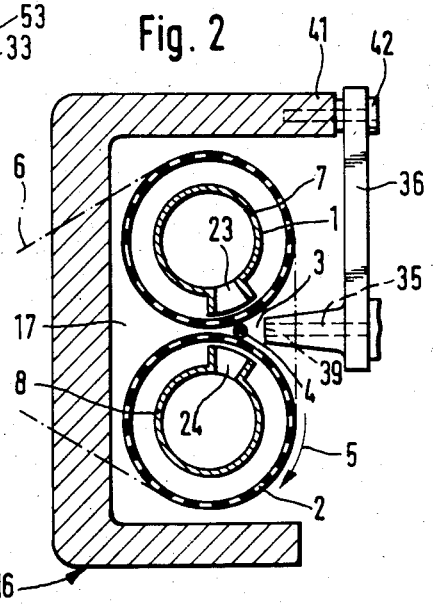
FIG. 2 is a partially cut view of the arrangement according to FIG. 1 in the direction of the shafts of the rollers (some elements having been omitted)
Figure 3:
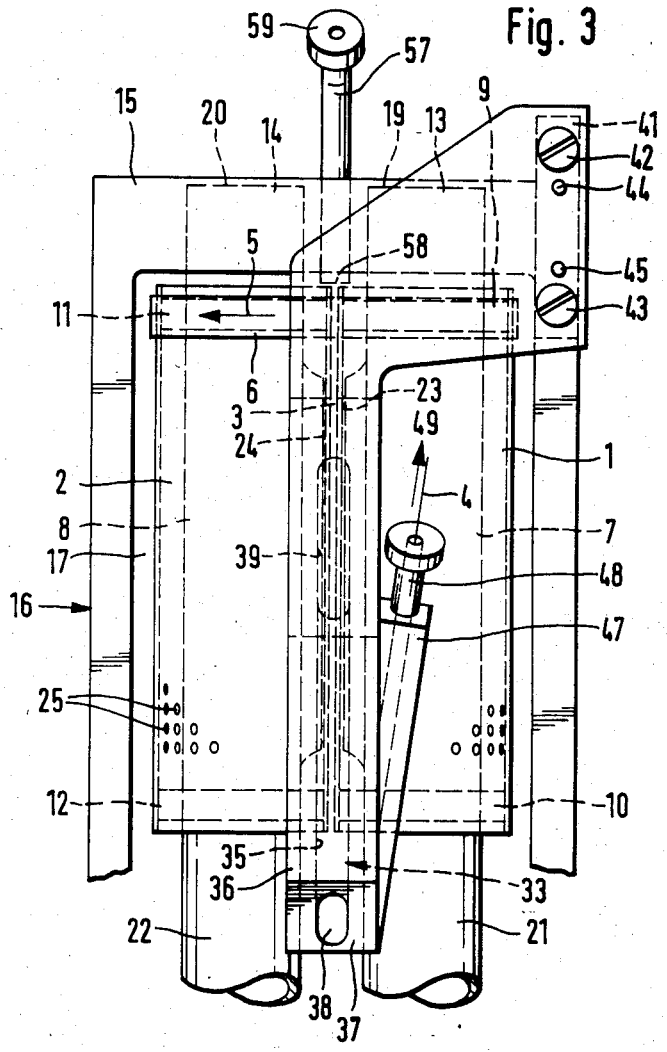
FIG. 3 is a view in the direction of Arrow III of FIG. 1.

The arrangement for open-end friction spinning shown in FIGS. 1 to 4 contains two rollers 1 and 2 that are arranged adjacent and in parallel to one another and together form a yarn-forming wedge-shaped gap 3 in which the forming of a yarn 4 takes place. The rollers 1 and 2 are drivable in the same rotational direction as indicated by Arrow 5 of FIG. 2. The drive takes place via a driving belt 6 which winds around the exterior shell surfaces of the rollers 1 and 2 and which, in a manner that is not shown in detail, is guided via a driving disk driven by an electric motor.

The rollers 1 and 2 each have cylindrical tubes which are, by means of roller bearings 9, 10 and 11, 12, disposed on pipes 7 and 8 that are arranged concentrically with respect to them. The pipes 7 and 8, with their ends 13 and 14, project beyond the front ends of the rollers 1 and 2 and in this area, are clamped into a holding means 15 that is shown only in diagram form. The holding means 15 is part of a structural unit comprising a roller housing 16 which, in a manner that is not shown in detail, is mounted on a support of the machine frame. The roller housing 16 which has a U-shaped cross-section (FIG. 2) forms a trough-shaped chamber 17 for the rollers 1 and 2. In the rear wall of the roller housing 16, a recess 18 is provided through which the driving belt 6 is led.

The front ends 19 and 20 of the pipes 7 and 8 are tightly closed, in the area of their clamped-in ends 13 and 14. The ends 21 and 22 that are facing away project from the rollers 1 and 2 and the roller housing 16 and (in a manner that is not shown in detail) are connected to a vacuum source. Preferably, a controllable valve is inserted upstream of the vacuum source. A duct is used as a vacuum source which extends in the longitudinal direction relative to the machine which is equipped with a plurality of such arrangements and is connected at the end of the machine to a ventilator.

In the interior of the rollers 1 and 2, the pipes 7 and 8 are each equipped with a suction slot 23 and 24 which is aimed at the area of the wedge-shaped gap 3. The shell surfaces of the rollers 1 and 2, at least in the area that comes in contact with the fibers, are equipped with perforations 25 so that in the area of the wedge-shaped gap 3, a suction air flow stream is generated that flows into the interior of the rollers 1 and 2. This suction air flow is used for holding the forming yarn 4 in the area of the wedge-shaped gap 3 as well as of the arriving fibers.

The fiber material to be spun is fed to the wedge-shaped gap 3 in the form of individual fibers. For this purpose, a feeding and opening device 26 is provided which contains an opening roller 26 which combs out a sliver fed by a feeding device into individual fibers. The opening roller 27 is arranged in an opening roller housing 28. It is disposed in a projection 30 for the opening roller housing 28 by means of a shank 29. The shank 29 protruding from the projection 30 is equipped with a shaft 32 which is driven by a tangential belt 32.

From the opening roller 26, the individual fibers are fed via a fiber feeding duct 33 which starts approximately tangentially at the circumference of the opening roller 26 and which is aimed at the wedge-shaped gap 3 with a slope of about 45°. The fiber feeding duct 33 extends essentially in the plane of the wedge-shaped gap 3. It is slot-shaped and with a slot-shaped mouth 39 leads into the area of the wedge-shaped gap 3. The mouth maintains a narrow separation 40 from the wedge-shaped gap 3 and extends essentially in parallel to it. The fiber feeding duct 33 consists of two parts 34 and 35 of which the first part 34 is formed into the opening roller housing 28. The second part 35 which extends as a straight extension of part 34 is formed into a structural component 36, which is separated from the opening roller housing 28 by means of a parting line 37.

The distance 40 of the mouth 39 of the fiber feeding duct 33 to the wedge-shaped gap 3 is important for the spinning conditions. It should therefore be fixed so precisely that deviations, if possible, are not greater than 100 microns. This requirement is met by the fact that the structural component 36 containing the mouth 39 is mounted rigidly at the roller housing 16. As a result, it is ensured that the roller housing 16 with the rollers 1 and 2 and the structural component 36 forms a premountable structural unit that can be precisely adjusted in the manufacturing plant. The roller housing 16, in the area of its end facing away from the opening roller housing 28, is equipped with a flange 41 at which the structural component 36 is fixed by means of screws 42 and 43. In order to be able to again precisely align the position of the structural component 36 and thus of the mouth 39 also after a loosening of the screws 42 and 43, without having to provide special fitting measures for this purpose, alignment pins 44 and 45 are provided between the flange 41 and the structural component 36.

Between the surfaces of the flange 41 and the structural component 367 facing one another which are both very precisely machined, precisely dimensioned distance plates 46 are arranged. By means of these distance plates 46, if necessary, the distance 40 between the mouth 39 of the fiber feeding duct 33 and the wedge-shaped gap 3 can be changed, for example, when a different fiber material is to be spun. This change is possible by using the distance plates 46 indicated by the manufacturing plant without the requireemnt of adjusting work during the change. No adjustment is required because by means of the alignment pins 44 and 45, deviations in a direction other than the thickness of the distance plates 46 are prevented.

The spun yarn 4 is withdrawn in the direction of the wedge-shaped gap, namely against the feeding direction of the fiber feeding duct 33. At the structural component 36, a projection 47 is mounted in which a yarn withdrawal pipe 48 is arranged that points diagonally upward. The withdrawn yarn 4, in the direction of the arrow 49, behind the yarn withdrawal pipe 48, is forwarded to a withdrawal device that is not shown and finally reaches a wind-up device where it is wound to a cross. The yarn 4 to be withdrawn first reaches an inlet 50 of a deflecting means 41 arranged as an extension of the wedge-shaped gap 3. The deflecting means 51 connects with the yarn withdrawal pipe 48. The yarn withdrawal pipe 48 and the deflecting means 51 are staggered with respect to the fiber feeding duct 33 in such a way that the two do not intersect.

The opening roller housing 28 is movably arranged in such a way that it can be separated from the structural component 36 in the area of the separating line 36 by being moved apart. For this purpose, the opening roller housing 28 is either moved around a swivel axis extending transversely to the fiber feeding duct 33 or, as in the shown embodiment, is movably guided in a diagrammatically shown axial guide 54 in the direction of the fiber feeding duct 33. The opening roller housing 28 in the direction toward the structural component 36 is loaded by means of a pressure spring 55 which supports itself at a stationary structural part 56. By means of the pressure spring 55, the opening roller housing 28 in the operating position (FIG. 1) is loaded in the direction of the structural component 36 so that the separating line 36 is tightly closed.

In the area of the separating line 37, entry slopes 52 and 53 are provided in the structural component 36 and the opening roller housing 28. Between these slopes, a cleaning head 61 having a wedge-shaped point can be inserted in such a way that the opening roller housing 28 against the effect of the pressure spring 55 is moved away from the structural part 36 in the direction of the Arrow 60. The cleaning head 61 is a component of a movable servicing apparatus 100 and is applied to the arrangement for carrying out servicing work. The cleaning head 61 is arranged on an arm 64 which by means of a drive can be slid in the direction of the Arrows 62 and 63. A compressed air supplying pipe 65 leads to the cleaning head 61 and, via a controllable valve, is provided at a vacuum source that is not shown. The cleaning head 61 is equipped with a pressure chamber 66 from which blow-out openings 67 and 68 are each aimed into the parts 34 and 35 of the fiber feeding duct 33 when the cleaning head 61 is located between the opening roller housing 28 and the structural part 36.

Figure 4:
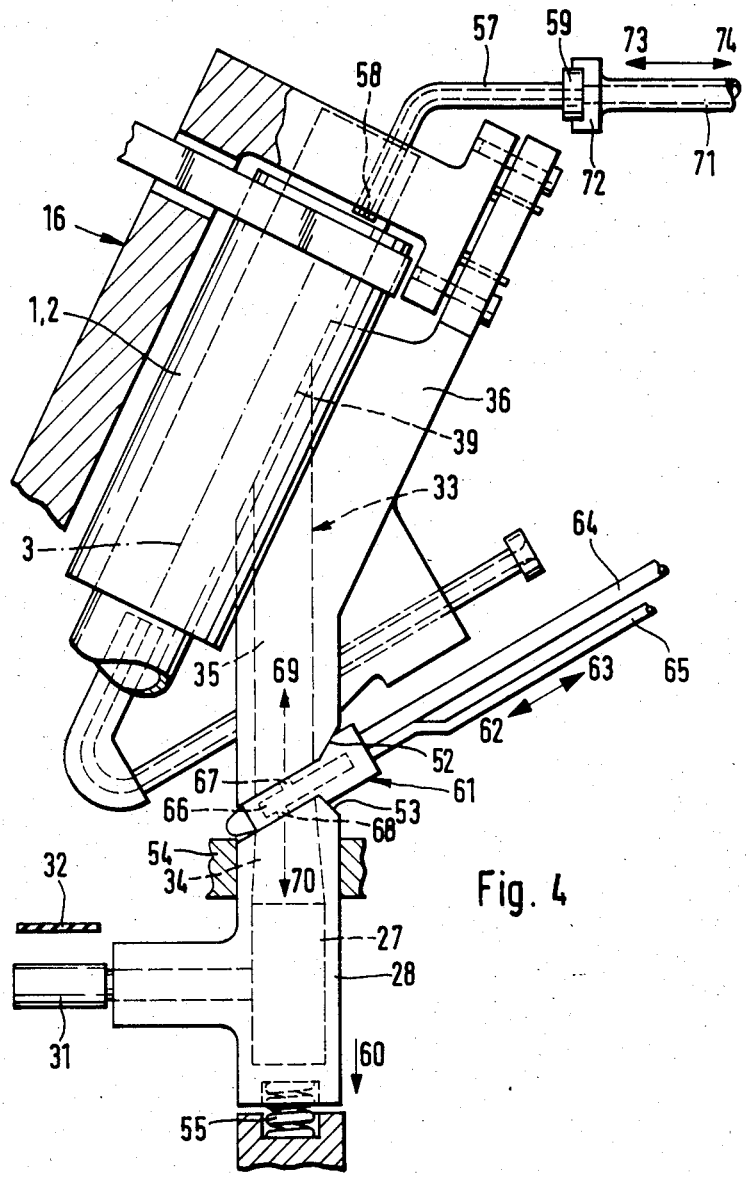
FIG. 4 is the arrangement according to FIG. 1 during a cleaning process with a cleaning device of a movable servicing apparatus being applied.

As shown in FIG. 4, from the cleaning head 61 currents of compressed air 69 and 70 are preferably blown in spurts into the parts 34 and 35 of the fiber feeding duct 33. The compressed air current flowing in direction 69 cleans the part 35 of the fiber feeding duct 33 and is also, from the mouth 39 blown into the wedge-shaped gap 3 in order to remove fiber residues or similar materials from the gap. The compressed air current aimed in the direction of the Arrow 70 cleans the part 34 and the circumference of the opening roller 27. This compressed air current can flow out via a cleaning opening that is not shown in the area of the wall of the opening roller housing 28 surrounding the opening roller 27.

As an extension of the wedge-shaped gap 3 a pipe 57 connectable with vacuum sources 90 is arranged on the side facing away from the yarn withdrawal direction. This pipe 57 is clamped into the front wall of the roller housing 16, and its entry opening 58 faces the wedge-shaped gap 3. After that, it is bent toward the outside and is equipped with a connecting piece 59. Instead of being connected with vacuum source 90, this connecting piece 59, by means of a coupling piece 72, can be connected with a suction pipe 71 which is part of servicing apparatus 100 and which can be adjusted in the direction of the Arrows 73 and 74. Via this suction pipe 71 and the pipe 57, a suction air flow during the cleaning is exercised away from the area of the wedge-shaped gap 3 by means of which the fiber residues and/or dirt or other materials detached by the compressed air current can be removed by suction.

As shown in FIGS. 1 to 4, the structural component 36 has an essentially compact web-shaped structure extending along the wedge-shaped gap 3. Because of the slope toward the wedge-shaped gap, essentially only the area of the mouth 39 is covered by this structural part 36. The remaining area of the rollers 1 and 2 is freely accessible. Also in this covered area, a perfect cleaning can be carried out because of the compressed air currents and the suction air currents. Because of the moving-away of the opening roller housing 28 in the direction of Arrow 60 caused by the cleaning head 61, at the same time also the shaft 31 of the opening roller 27 is detached from the tangential belt 32 driving it.

Figure 5:
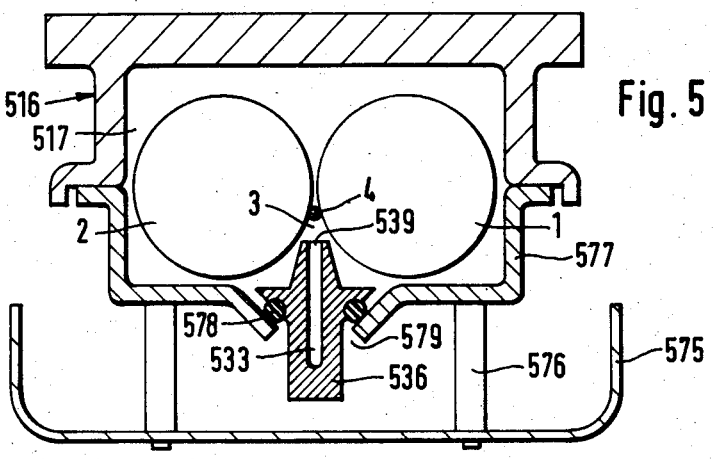
FIG. 5 is a view similar to FIG. 2 through another embodiment with a stationary structural component containing the mouth of the fiber feeding duct and with a covering for the rollers in accordance with the present invention.

The embodiment according to FIG. 5, in its basic construction, corresponds to the embodiment according to FIGS. 1 to 4. Also in this embodiment, the rollers 1 and 2 that are only outlined are disposed on shafts which are clamped into a structural unit comprising a roller housing 516. The structural part 536 containing the mouth 539 of the fiber feeding duct 533 is correspondingly mounted at the roller housing 516 in a stationary manner. Here also, this structural component 536 has a compact web-shaped form extending in the direction of the wedge-shaped gap 3 between the two rollers 1 and 2. In order to additionally cover and enclose the rollers 1 and 2, a covering 577 is provided which rests at least against the side walls of the roller housing 516 with corresponding side walls so that the chamber 517 is largely closed and the rollers 1 and 2 are enclosed by it. The covering 577 is developed in such a way that it can be moved away from the roller housing 516 preferably by being swivelled away without being impaired by the stationary structural component 536. For this purpose, a recess 579 is provided in the covering 577 in which the compact structural component 536 is located in operating position. A sealing means 578 is inserted into the recess 579 which seals the structural part 536 against the recess 579 in the operating position.

The covering 577, via stud bolts 576, is mounted at a casing 575 by means of which the arrangement as a whole is covered. This is true, for example, also in the case of the casing 675 of the embodiment according to FIG. 6. This casing 575 which is made of plastic or sheet-metal is preferably held by a pivotal shaft arranged below the arrangement and extending in the longitudinal direction relative to the machine. It is in each case used for the covering of the arrangement.

Figure 6:
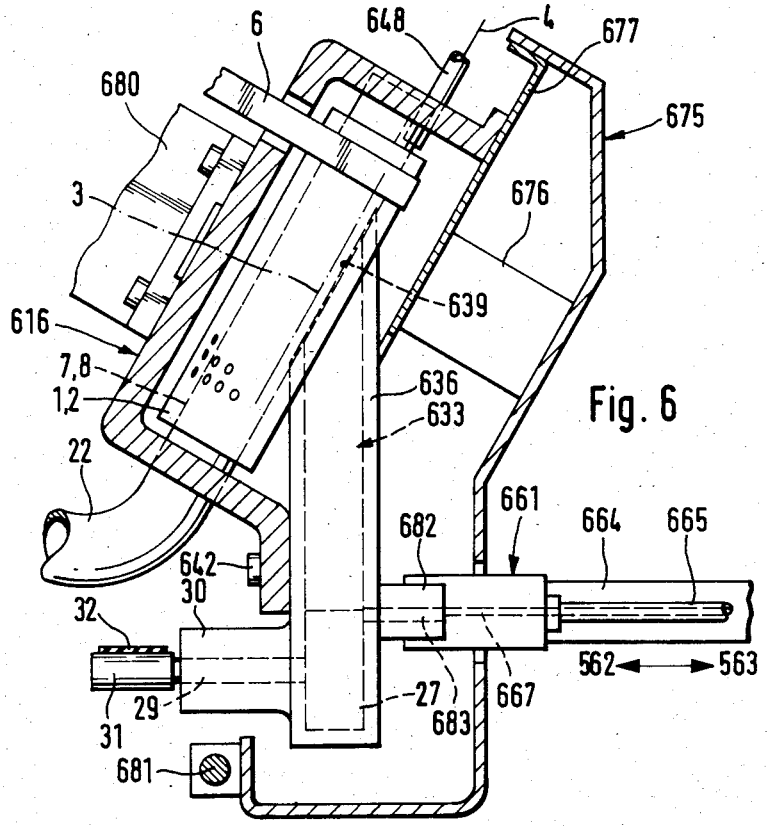
FIG. 6 is a view similar to FIG. 4 of an embodiment with a stationary fiber feeding duct which is constructed to be in one part with an opening roller housing in accordance with the present invention.

Also in the case of the embodiment according to FIG. 6, the fiber feeding duct 633 with its mouth 639 is stationarily assigned to the rollers 1 and 2. The rollers 1 and 2 are disposed on shafts 7 and 8 developed as suction pipes. The shafts 7 and 8 are clamped in a roller housing 616 corresponding to the embodiment according to FIGS. 1 to 4. The roller housing 616 is fastened to a machine support 680. The two rollers 1 and 2 by means of a driving belt 6 are drivable jointly and in the same rotational direction. This embodiment provides that the opening roller housing 636 with respect to the area receiving the fiber feeding duct 633 is developed in one piece. This opening roller housing 636 is arranged in a stationary manner. It receives the opening roller 27 which with its shank 29 is disposed in a projection 30 and the shaft 31 of which is driven by a tangential belt 31. It is fastened directly to the roller housing 616 by means of screws 642 and preferably by additional alignment pins and possibly also precisely dimensioned distance plates. In the case of the embodiment according to FIG. 6, just as in the case of the embodiment according to FIGS. 1 to 4, the feeding and opening device is arranged below the rollers 1 and 2.

The fiber feeding duct 633 extends essentially in the plane of the wedge-shaped gap 3 and is aimed at an acute angle at this wedge-shaped gap 3 from below. However, in the case of the embodiment according to FIG. 6, the withdrawal of the spun yarn 4 takes place essentially in the feeding direction of the fiber feeding duct 33, i.e., in the case of the embodiment according to FIG. 6 in an upward direction. For this purpose, a yarn withdrawal pipe 648 is arranged in the roller housing 616.

In order to be able to clean the fiber feeding duct 633 and the area of the wedge-shaped gap 3, a connection piece 682 is provided at the opening roller housing 636 which contains an air feeding duct 683 leading into the fiber feeding duct 633. A cleaning head 661 of a movable servicing apparatus is applicable to the connection piece 682 and can be moved in and out in the direction of the Arrows 562 and 563. The cleaning head 661 is arranged on an arm 664 and is connected to a compressed-air supplying pipe 665.

In the case of the embodiment according to FIG. 6, similar to the embodiment according to FIG. 5, the roller housing 616 is closed by a covering 677 which is only outlined in FIG. 6. This covering 677 which rests against a surrounding edge of the roller housing 616 is equipped with a recess for the fiber feeding duct 633 of the opening roller housing 636. The covering 677, by means of rubber-elastic holding means 676, is fastened to a casing 675 which can be swivelled around a pivotal shaft 681 located below the feeding and opening device and extending in the longitudinal direction of the machine. The casing 675 in its operating position, in a manner that is not shown in detail, is held by means of a locking device in such a way that the covering 677 by means of the holding means 676 is pressed elastically against the roller housing 616.

Figure 7:
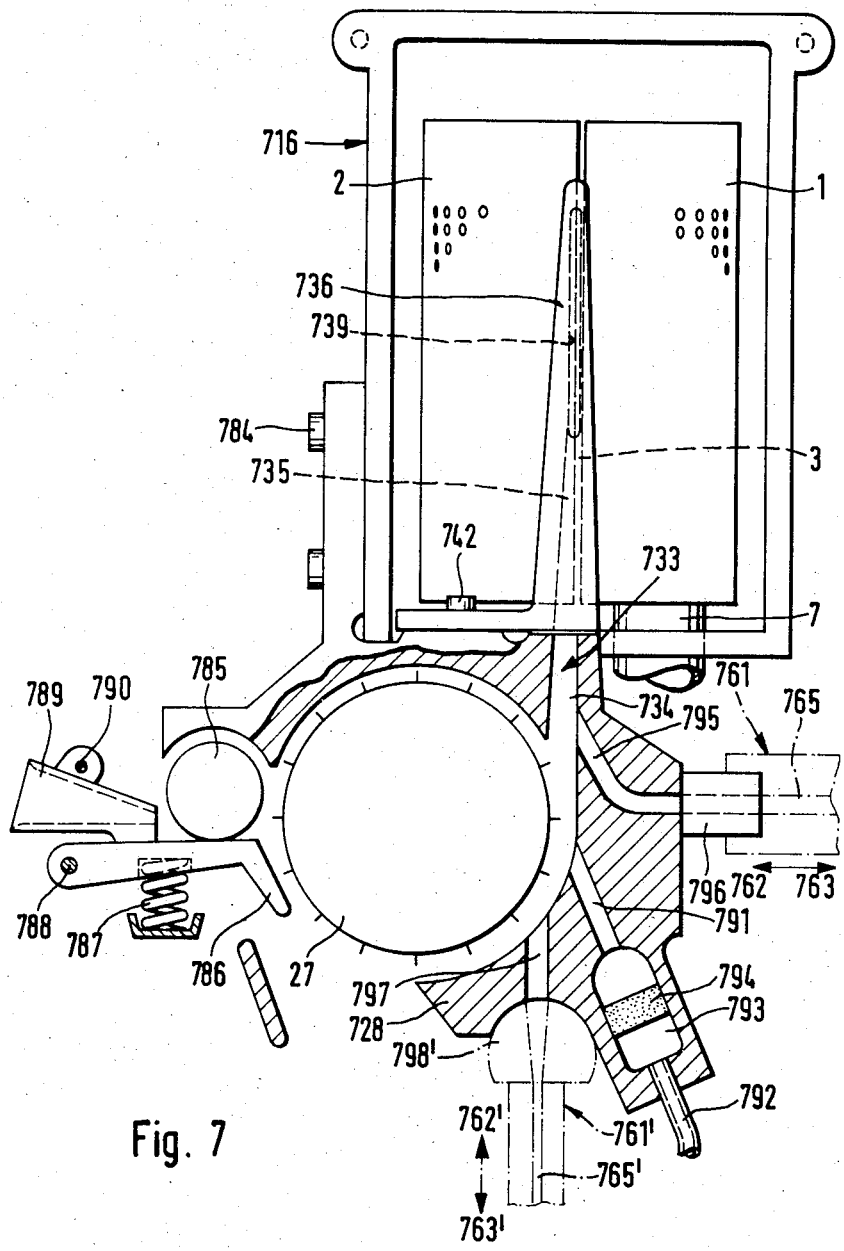
FIG. 7 is a view of another embodiment with an opening roller housing that is stationarily mounted to the structural component receiving the bearing of the rollers and a structural component mounted on the housing containing the mouth of the fiber feeding duct in accordance with the present invention.

Also in the case of the embodiment according to FIG. 7, two rollers 1 and 2 are disposed on pipes 7 and 8 which are clamped into walls of the structural unit comprising a roller housing 716. Also in the case of this embodiment, the feeding and opening device is arranged below the rollers 1 and 2 and staggered to the front in the direction of the operating side so that an essentially vertically aligned fiber feeding duct 733 transports the individual fibers to the wedge-shaped gap 3 formed by the two rollers 1 and 2.

The feeding and opening device contains an opening roller 27 in front of which a feeding roller 785 is arranged which interacts with a feeding table 786 that swivels around a shaft 788 and is pressed against it by means of a spring 787. The sliver which is not shown in fed to the nip gap between the feeding roller 785 and the feeding table 786 via a feeding funnel 789 which can be swivelled around a shaft 790. The opening roller 27 combs out the fed sliver and opens it up into individual fibers which then are transported further via the fiber feeding duct 733 starting essentially tangentially to the circumference of the opening roller 27 equipped with a set of teeth or needles. The opening roller 27 is arranged in an opening roller housing 728 and in a manner that corresponds to the embodiment according to FIGS. 1 to 4, is driven by means of a tangential belt. As shown in FIG. 7, in the area connecting to the feeding table 786, opening roller housing 728 has a discharge opening opposite the circumference of opening roller 27. The opening roller housing 728, by means of screws 784, is mounted directly on the roller housing 716. Advantageously, alignment pins are in this case also provided between the roller housing 716 and the opening roller housing 728 in order to fix the determine precise position so that it can be repeated as often as required without any alignment work.

A first part 734 of the fiber feeding duct 733 is worked into the opening roller housing 728. The part 734 then is continued by a second part 735 leading to the mouth 739 which is opposite the wedge-shaped gap 3 and extends essentially in parallel to it. The second part 735 of the fiber feeding duct 733 is worked into a compact web-type structural component 736 which is located essentially in the plane of the wedge-shaped gap, in the plane that is placed through the wedge-shaped gap 3 extending perpendicularly with respect to the plane connecting the two shafts 7 and 8 of the rollers 1 and 2. As shown in FIG. 7, only a relatively small area of the rollers 1 and 2 is covered by the structural part 736. The structural part 736 is rigidly fastened by means of screws 742 with a flange at a projection of the opening roller housing 728. The structural part 736, only for manufacturing reasons, is manufactured separately from the opening roller housing 728. However, during the assembly in the manufacturing plant, it is built together with the opening roller housing 728 into a structural unit, which later is not to be disassembled. As shown in FIG. 7, the opening roller housing 728 and the roller housing 716 also form a premountable structural unit.

A compressed air pipe 792 is connected to the opening roller housing 728 which via a chamber 793 is connected with a compressed air duct 791 that is aimed at the beginning of the fiber feeding duct 733. The chamber 793 contains a porous insert 794, for example, made of sintered pearl bronze, by means of which the blown-in compressed air current is made uniform. By means of this additionally blown in compressed air current, the detaching and alignment of the fibers from the opening roller 27 is to be improved.

In order to carry out a cleaning of the wedge-shaped gap 3, when required, without disassembling the opening roller housing 728, it is provided that via the compressed air pipe 792 a compressed air current is fed that is considerably higher as compared to the operational condition. This compressed air current, via the mouth 739 of the fiber feeding duct 733, is blown into the wedge-shaped gap 3. In order to increase the pressure, a control valve is then advantageously provided in the compressed air pipe 792 which, by means of a servicing apparatus that is not shown, can be switched from the lower compressed air value to the higher compressed air value.

However, in order not to be required to have an unnecessarily high super pressure constantly available for each spinning arrangement, it is provided in the case of the embodiment according to FIG. 7 that a compressed air duct 795 that is sloped in transport direction of the fiber feeding duct 733 leads into the fiber feeding duct 733 in the area of the part 734. This compressed air duct 795 leads to an exterior connection piece 796. If necessary, a cleaning head 761 can be applied to the connection piece 796 which is equipped with a compressed-air supplying pipe 765. Via this cleaning head 761 compressed air is then blown in preferably in spurts which, via the mouth 739 of the fiber feeding duct 733 is blown into the wedge-shaped gap 3 for cleaning purposes. It is advantageous that in the case of this embodiment, in a manner that corresponds to the embodiment according to FIGS. 1 to 4, a pipe is provided which can be connected to a vacuum source and which removes by suction the detached dirt or fiber residues. The cleaning head 761 is a component of a movable servicing apparatus 700 and by means of a drive can be moved in the direction of the Arrows 762 and 763.

In the opening roller housing 728, a bore 797 is also provided which as an extension of the fiber feeding duct 733 is aimed approximately tangentially to the opening roller 28 and leads out into the open air. Via this bore 797, air is taken in by suction in the normal operation by means of which the fiber transport can be affected. In the case of a modified embodiment, instead of the compressed-air duct 795 and the cleaning head 761 assigned to it, a cleaning head 761' of servicing apparatus 700 is applied to the bore 797 in the direction of the Arrows 762' and 763'. This cleaning head 761' is connected to a compressed-air supply pipe 765'. The cleaning head 761' which has a connection piece 798' will then allow the fiber feeding duct 733 to be cleaned completely and also the circumference of the opening roller 27 to be cleaned by means of a compressed-air current which is blown out of the mouth 739 for the cleaning of the wedge-shaped gap 3.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed:

1. An apparatus for open-end friction spinning including a pair of adjacently arranged friction rollers, both said rollers being rotatably disposed in a single common structural unit means, and fiber feeding duct means having a mouth portion, said rollers defining a yarn forming wedge-shaped gap therebetween and said mouth portion extending along said wedge-shaped gap, comprising:

rigid connecting means for fixedly connecting said mouth portion of said fiber feeding duct means to said single common structural unit means rotatably supporting said pair of rollers, thereby causing said mouth portion to be positively located relative to said wedge shaped gap.

2. An arrangement according to claim 1, wherein said fiber feeding duct means includes a first part containing said mouth portion and a second part, said first part being fixedly connected to said structural unit means, said second part being displaceably supported relative to said first part.

3. An arrangement according to claim 2, wherein said first part is contained in a structural element, said structural unit means comprising a friction roller housing means, said structural element being fixedly mountable on said roller housing.

4. An arrangement according to claim 1, including opening roller housing means integral with said fiber feeding duct means, said structural unit means comprising friction roller housing means for rotatably supporting said rollers, said opening roller housing means being fixedly attached to said friction roller housing means.

5. An arrangement according to claim 1, including opening roller housing means containing a portion of said fiber feeding duct means, said structural unit means comprising friction roller housing means, said opening roller housing means being rigidly connected to said friction roller housing means, wherein a part of said fiber feeding duct means having said mouth portion is rigidly connected with said opening roller housing means.

6. An arrangement according to claim 1, wherein said mouth portion of said fiber feeding duct is contained in compact structural part means extending along said wedge-shaped gap.

7. An arrangement according to claim 6, comprising covering means for covering said rollers, said structural unit means comprising roller housing means, said covering means and said roller housing means forming a chamber surrounding said rollers.

8. An arrangement according to claim 7, wherein said compact structural part means containing said fiber feeding duct means is disposed in a recess in said covering means.

9. An arrangement according to claim 1, wherein said fiber feeding duct means includes vacuum source connecting means for cleaning said fiber feeding duct and said wedge-shaped gap.

10. An arrangement according to claim 1, wherein said fiber feeding duct means includes compressed air source means for connecting for cleaning said fiber feeding duct means and said wedge-shaped gap.

11. An arrangement according to claim 2, including compressed-air source connecting means insertable between said first part and said second part upon displacement of said second part for cleaning said fiber feeding duct means and said wedge-shaped gap.

12. An arrangement according to claim 10, wherein said fiber feeding duct means includes compressed air connection means for supplying compressed air to said mouth portion.

13. An arrangement according to claim 11, comprising movable servicing means, said movable servicing means including said compressed-air source means for supplying compressed air to said fiber feeding duct means and said wedge-shaped gap.

14. An arrangement according to claim 12, comprising movable servicing means, said movable servicing means including said compressed-air source means for supplying compressed air to said fiber feeding duct means and said wedge-shaped gap.

15. An arrangement according to claim 13, wherein said servicing means includes moving means for displacing said second part.

16. An arrangement according to claim 15, wherein said compressed-air source means comprises head piece means insertable between said first part and said second part.

17. An arrangement according to claim 16, wherein said head piece means is provided with blow openings, said blow openings being capable of directing air flow into said first part and said second part of said fiber feeding duct means.

18. An arrangement according to claim 1, including suction pipe means for cleaning said wedge-shaped gap and vacuum connecting means for connecting said pipe to a vacuum source.

19. An apparatus for open-end friction spinning including a pair of adjacently arranged friction rollers rotatably disposed in structural unit means and fiber feeding duct means having a mouth portion, said rollers defining a yarn forming wedge-shaped gap therebetween and said mouth portion being disposed opposite said wedge-shaped gap, comprising:

rigid connecting means for fixedly connecting said mouth portion of said fiber feeding duct means to said structural unit means rotatably supporting said pair of rollers, said fiber feeding duct means including a first part containing said mouth portion and a second part, said first part being fixedly connected to said structural unit means, said second part being displaceably supported relative to said first part.

20. An arrangement according to claim 19, including compressed-air source connecting means insertable between said first part and said second part upon displacement of said second part for cleaning said fiber feeding duct means and said wedge-shaped gap.

21. An arrangement according to claim 20, comprising movable servicing means, said movable servicing means including said compressed-air source means for supplying compressed air to said fiber feeding duct means and said wedge-shaped gap.

22. An apparatus for open-end friction spinning including a pair of adjacently arranged friction rollers rotatably disposed in structural unit means and fiber feeding duct means having a mouth portion, said rollers defining a yarn forming wedge-shaped gap therebetween and said mouth portion being disposed opposite said wedge-shaped gap, comprising:

rigid connecting means for fixedly connecting said mouth portion of said fiber feeding duct means to said structural unit means rotatably supporting said pair of rollers, said fiber feeding duct means including compressed air source connecting means for cleaning said fiber feeding duct means and said wedge-shaped gap, said apparatus including movable servicing means, said movable servicing means including compressed-air source means for supplying compressed air to said fiber feeding duct means and said wedge-shaped gap.

23. An arrangement according to claim 21, wherein said servicing means includes moving means for displacing said second part.

24. An arrangement according to claim 23, wherein said compressed-air source means comprises head piece means insertable between said first part and said second part.

25. An arrangement according to claim 24, wherein said head piece means is provided with blow openings, said blow openings being capable of directing air flow into said first part and said second part of said fiber feeding duct means.

* * * * *